United States Patent [19]

Bertoldi

[11] 4,152,908

[45] May 8, 1979

[54] DEVICE FOR THE CONTINUOUS SETTING OF WOOLLEN OR UNION FABRICS

[76] Inventor: Attilio Bertoldi, Via Luzzago 27, Manerbio (Brescia), Italy

[21] Appl. No.: 839,838

[22] Filed: Oct. 6, 1977

[30] Foreign Application Priority Data

Oct. 15, 1976 [IT] Italy ..... 28361 A/76

[51] Int. Cl.[2] ..... D06B 3/22

[52] U.S. Cl. ..... 68/9; 68/5 E; 68/15; 68/158; 68/183

[58] Field of Search ..... 68/5 E, 9, 15, 158, 68/175, 183, DIG. 5

[56] References Cited

U.S. PATENT DOCUMENTS

| | | | |
|---|---|---|---|
| 2,387,200 | 10/1945 | Walter | 68/5 E X |
| 2,764,009 | 9/1956 | Sarti | 68/15 |
| 2,834,193 | 5/1958 | Fahringer | 68/5 E |
| 3,886,769 | 6/1975 | Conti | 68/DIG. 5 |

FOREIGN PATENT DOCUMENTS

| | | | |
|---|---|---|---|
| 1785705 | 4/1976 | Fed. Rep. of Germany | 68/DIG. 5 |
| 473549 | 10/1937 | United Kingdom | 68/175 |

*Primary Examiner*—Philip R. Coe
*Attorney, Agent, or Firm*—Steinberg & Blake

[57] ABSTRACT

A device for the continuous setting of woollen or union goods, wherein the fabric is caused to cling to the contour of a revolving drum, which is at least partly dipped into a body of hot liquid inside of a container, within which heating means are fitted close to said drum, being preferably means to exert a pressure on said liquid also provided.

5 Claims, 3 Drawing Figures

DEVICE FOR THE CONTINUOUS SETTING OF WOOLLEN OR UNION FABRICS

BACKGROUND OF THE INVENTION

This invention concerns a device for the continuous setting of woollen or union goods.

As well known, woolen or union goods are submitted, before or after scouring and/or fulling, to a heat treatment, i.e. the so called setting, the purpose of which is to prevent the formation of creases or to remove the creases already formed in the course of previous treatment. Such wet heat treatment comprises a heating of the fabric dipped in water, up to a temperature at which a given plasticity is taken by the wool, followed by a sudden cooling.

DESCRIPTION OF THE PRIOR ART

Recourse has heretofore been made to two types of setting equipment, i.e. a continuously operating device, and a discontinuously operating device. Latter device practically consists of an autoclave or kier, wherein the possibility is given to attain an optimum setting temperature, higher than 100° C. However, the throughput of such a device is low, and it also requires much labor since only a given, small length of fabric can be processed at one time. Thus, all drawbacks inherent to discontinuous methods are shown by such device.

The continuously operating devices, while allowing higher throughputs, do not allow to attain the optimum temperature, whereby the results are not satisfactory.

SUMMARY OF THE INVENTION

The object of the present invention is the provision of a device for the setting of woolen or union goods that can be continuously operated and wherein the optimum temperature for the setting of fabric can be attained.

Briefly, the device according to the invention is essentially characterized in that the fabric is caused to cling to the contour of a drum, which is at least partly dipped into a body of heated liquid, inside of a container, leaving however an intervening space, wherein the heating means are fitted.

In an advantageous embodiment form of the invention, the fabric is caused to travel across a chamber wherein a heated, pressurized liquid is present, such chamber being connected with the outside through at least one inlet duct and at least one outlet duct, which are also run across by the fabric, such ducts being designed on the principle of liquid column pressure gauges.

According to an important feature of the invention, the drum is revolvingly driven, and it can advantageously be hollow, whereby the drum can be heated from the inside, e.g. by steam or by any other suitable mean.

In one embodiment of the invention, the drum is wholly dipped into water, whereby its whole contour is kept under a given hydrostatic pressure.

Various general and specific objects, as well as further advantages of the invention will become apparent when reference is made to the following detailed description of the invention, considered in conjunction with the related drawings, both description and drawings being given as a non-restrictive example only.

DETAILED DESCRIPTION OF THE INVENTION

Figure 1:
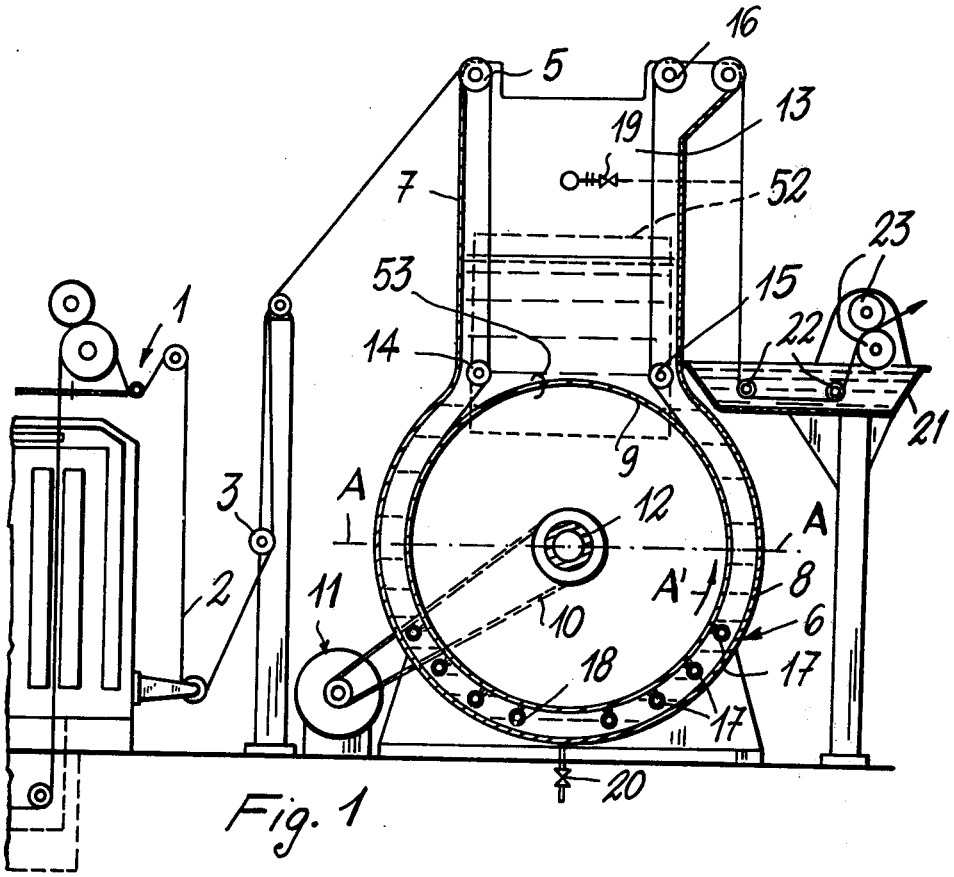
FIG. 1 is a diagrammatic vertical cross-section of the device.

In the drawings, a scouring and/or fulling machine of the already known, continuously operated type, is indicated generally by the reference numeral 1.

The fabric 2, coming from the machine 1, is led by deflecting rollers 3 into a metal vessel or container 6, characterized by a top section or neck 7, and by a wider lower section or "belly" 8, wherein an e.g. metal drum 9 is fitted.

Said drum 9 is driven in the direction or arrow A' by a geared motor 11 through a chain transmission 10.

The hollow drum 9 is supported by an also hollow shaft 12, which is formed with radial openings, thereby allowing a heating fluid, e.g. steam, to be fed into the drum inside, this fluid being fed from a suitable source through a valve and a conventional packing.

The drum temperature is controlled by a thermostat, a thermocouple or like device (not shown), by which the above valve is acted upon.

The vessel 6 comprises two multi-section side walls 13, to allow for the assembling of drum 9, and a front wall shaped as shown in the drawing. The drum 9 is supported by the side walls 13.

By a roller 14 which is supported, like the roller 5, by the side walls 13, the fabric is caused to cling against the outer side of drum 9 and is separated therefrom at the level of a roller 15, whereupon it is led out of vessel 6 by a guide roller 16.

Fitted in the intervening space, as defined between the drum 9 and the "belly" 8 are a row of ducts 17, extending parallel to drum axis, supported between the side walls 13 and connected with a source of steam through a valve, by which the steam inflow is controlled, and that is controlled, in turn, by a thermostat, thermocouple or like device, by which the temperature of water, present in the intervening space, is sensed. Said ducts are formed with holes, or fitted with nozzles 18, directed toward the drum.

Said row of pipes 17 are preferably fitted within said intervening space below the horizontal diametral plane of drum 9.

The vessel 6 is filled with water up to a level such as to wholly submerge the drum 9, thus bringing into being a given hydrostatic pressure against the contour thereof, such pressure having its highest value against the lower drum side where the heating is provided. The water level is kept constant by acting on a water inflow duct 19, through a valve controlled by a float, thrustmeter or like level sensing means. The filling water is conveniently pre-heated, e.g. by a water-steam mixing device, up to a temperature close to boiling, to prevent any abrupt drop of temperature.

A drain 20 is provided in the bottom of vessel 6.

Thus the fabric, when traveling in the vessel, is heated up to the temperature as required for having a suitable plasticity imparted to the wool.

The warm fabric is then led into a cooling tank 21, filled with cold water, into which the fabric is dipped by loose fitted rollers 22, with which the tank 21 is equipped. Then it is passed between a pair of wringing rollers 23, and is collected in any, already known manner.

Figure 2:
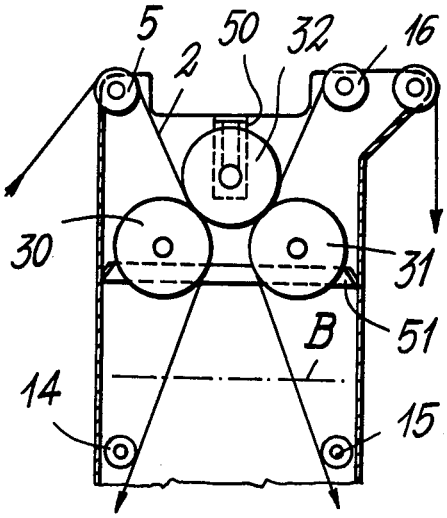
FIG. 2 similarly shows a detail of a modified embodiment form.

Shown in the FIG. 2 is a device that can be fitted in the neck 7 of vessel 6, whereby to form a kind of barrier, whereby a given pressure is exerted by the steam onto the water level B. Such device substantially consists of three, loose fitted rollers 30,31,32, having axes located at the vertexes of an imaginary triangle, the roller shafts being supported by the walls 13. The whole cross-section of neck 7 is substantially taken-up by said rollers.

The roller 32 may be made of soft rubber, while the other two rollers are made of a hard material, e.g. a metal. Said roller 32 rests against the underlying rollers by its own weight, and its shaft is slidingly fitted in guides 50, which allows for a lifting thereof in the case of undues overpressures, as well as to allow for the insertion of fabric, before the machine is started. Moreover, in order that a given overpressure be formed below the three rollers 31,32,33, a Teflon or like packing is urged into contact with the outer and side contours of both lower rollers 30,31, thus acting as a doctor blade 51.

To allow for the insertion of fabric before the machine is started, a tight closing door 52 is provided in at least one of side walls 13, while hooks 53 are fitted on the drum for hooking-up the fabric.

Figure 3:
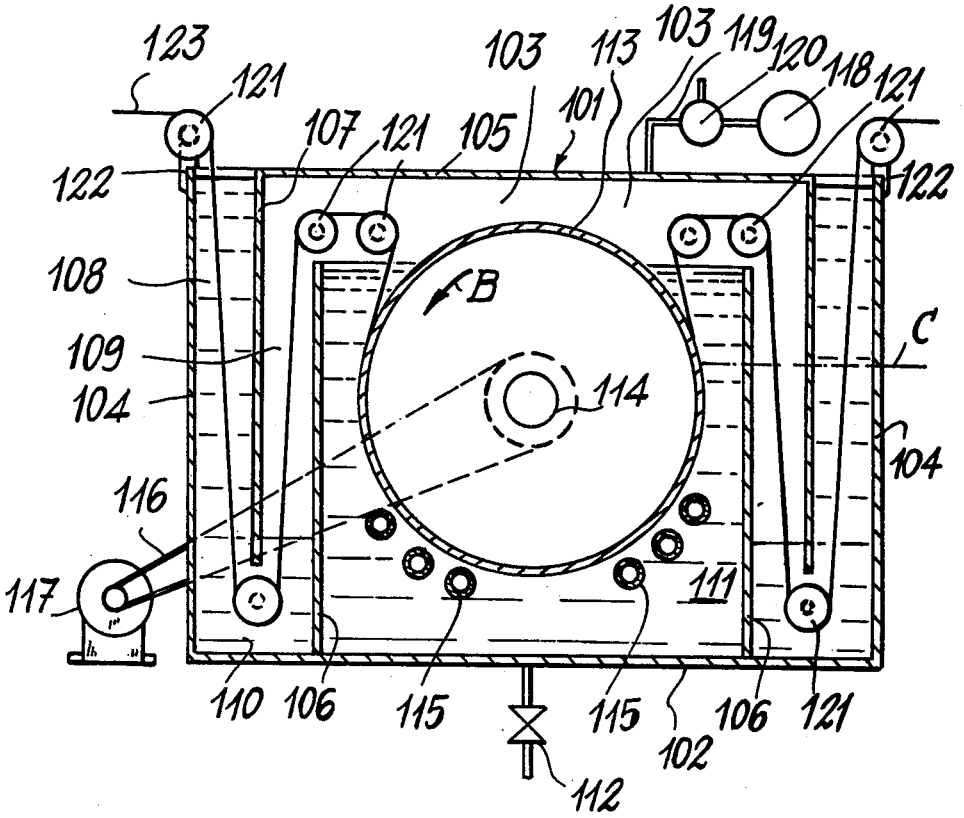
FIG. 3 similarly shows a further modified embodiment form.

Referring now to FIG. 3, the device comprises a shell 101 of metal sheet, made up of a bottom 102, two side walls 103, two head walls 104 and a cover 105, all connected with each other. Fitted inside of shell 101 are two crosswise directed partition walls 106, parallel to head walls 104, that extend from the one to the opposite side walls 103, and from the bottom 102 upwardly, without however coming into contact with the cover 105.

Fitted between each head wall 104 and each crosswise directed wall 106 is an intervening wall 107, that extends from the one to the opposite side walls 103 and from the cover 105 toward the bottom 102 without however coming into contact therewith.

An U-shaped channel, consisting of two sides 108,109 and of a bottom 110 is defined by the three walls 104,106,107, along with the bottom 102 and with the side walls 103.

A chamber 111, which is in communication with the U-shaped channels, is defined by the two walls 106, along with the bottom 102 and the side walls 103.

Said chamber 111 can be connected by already known means, not shown (e.e. a pipe and a valve, and possibly a pre-heater) with the water pipe network. A drain controlled by a valve 112 is moreover provided at the bottom of same chamber 111.

Fitted within the chamber 111 is a hollow drum 113, having journals 114 sealed by conventional packings (not shown), and by which it is revolvingly supported in the side walls 103 of chamber 111.

Extending along the lower contour of drum 113 are heating means which, even in the considered example, similarly to what described with reference to the FIG. 1, consist of a row of pipes 115, extending parallel to drum axis, supported between the side walls 103, and connected with a source of steam (not shown) through a valve by which the delivery of steam is controlled, and that is in turn controlled by a thermostat, a thermocouple of other similar instrument, by which the temperature of water present in the chamber 111 is sensed. Said pipes are preferably formed with holes, whereon nozzles directed toward the drum are fitted.

The drum 113 is driven in the direction of arrow B, by a geared motor 117, through a chain transmission 116.

A source 118 of a pressure fluid (compressed air) can be connected through a pipe 119 and a three-way valve 120 with the section of shell 101 which is defined substantially by the cover 105 and the plane wherein the upper edges of walls 106 are situated.

The fabric 123 is guided by a number of loose fitted rollers 121, supported between the side walls 103 or by bearings 122 in such a manner as to cause it to travel across the two U-shaped channels (108, 109 and 110), whereupon same fabric is wound about a part of the contour of drum 113.

The operation is as follows:

Water is fed into the chamber 111. Such possibly pre-heated water, after having filled said chamber, overflows round the upper edges of walls 106 and the water inflow is stopped when the U-shaped channels are filled up to a given level. Let us assume, as an example, that the level C is attained by the overflow water. Then the heating means 115 are started and the shell is connected with the source of compressed air 118. Owing to the pressure exerted on the water present in said chamber, the water boiling point is increased, whereby the water can be heated up to a temperature higher than 100° C., i.e. up to the values which are the most suitable to obtain the required setting effect.

Due again to the pressure, the U-shaped channels will behave themselves like a liquid column pressure gauge, whereby different levels (e.g. as shown in the drawing) are taken up by the liquid in the two branches 108,109. The pressure acting on the water in the chamber 111 is then indicated by the difference in the levels.

The drum 113 is turned and the advancing fabric is thus set.

Included within the scope of the appended claims is a solution by which the liquid contained in the U-shaped channel(s) is heated by any other, already known, suitable means.

Moreover, electric resistances can be utilized in place of the heating means 115.

Obviously the cover 105 is fitted with tightly closed doors for inspection purposes and for pulling the fabrics round the rollers and the drum.

What I claim is:

1. Apparatus for setting woolen or union fabrics comprising:

a vessel defining a lower interior chamber portion adapted to receive a rotatably mounted cylindrical drum therein, and an upper interior chamber portion in fluid communication with said lower chamber portion, the interior of said vessel normally being open to the external atmosphere at the upper end of said upper chamber portion; a drum having a cylindrical outer surface rotably mounted within said lower interior chamber portion of said vessel;

means for continuously conducting a length of fabric into said vessel through the upper chamber portion thereof around the outer surface of said drum in lapping contacting relationship thereto and out of said vessel through the upper chamber portion thereof;

means for filling said vessel with liquid and for maintaining said liquid at a level defined by a horizontal plane passing through said upper chamber portion so that said drum is completely immersed in said liquid;

means situated within said lower chamber portion proximate to the lower portion of the surface of said drum for injecting steam maintained at a temperature higher than 100° C. into liquid immediately adjacent to the fabric portion lapping said lower portion of said drum, said adjacent liquid being maintained at a temperature greater than 100° C. by the elevated hydrostatic pressure existing in said lower chamber portion.

2. Apparatus as recited in claim 1 wherein said lower chamber portion is defined by a substantially cylindrical cross-section and said upper chamber portion is defined by substantially vertically extending wall portions spaced from each other by a distance less than the inner diameter of said cylindrical lower chamber portion thereby forming a neck portion of said vessel.

3. Apparatus as recited in claim 2 wherein said drum is hollow and further including means for heating said drum.

4. Apparatus as recited in claim 3 further including means provided at the upper end of said upper chamber portion for fluidly sealing the interior of said chamber from the external atmosphere.

5. Apparatus as recited in claim 3 further including tank means situated adjacent to said vessel for cooling said fabric and means for conducting said fabric from said vessel into and out of said tank.

* * * * *